United States Patent [19]

Sato

[11] Patent Number: 4,739,958

[45] Date of Patent: Apr. 26, 1988

[54] GOLF BAG SUPPORT

[76] Inventor: Richard K. Sato, 8285 Holland Ct., Arvada, Colo. 80005

[21] Appl. No.: 26,117

[22] Filed: Mar. 16, 1987

[51] Int. Cl.[4] ..... A63B 55/04

[52] U.S. Cl. ..... 248/96; 206/315.7; 248/359 E

[58] Field of Search ..... 248/96, 359 E, 359; 206/315.3, 315.4, 315.5, 315.6, 315.7, 315.8

[56] References Cited

U.S. PATENT DOCUMENTS

| | | | |
|---|---|---|---|
| 1,135,464 | 4/1915 | Parnall | 248/96 |
| 1,197,298 | 9/1916 | McGregor | 248/96 |
| 1,578,910 | 3/1926 | Nidle | 248/96 |
| 1,686,774 | 10/1928 | Sperry | 248/96 |
| 1,752,114 | 3/1930 | Shaw | 248/96 |
| 1,924,182 | 8/1933 | Fritz | 248/96 |
| 2,324,439 | 7/1943 | Thommen | 248/96 |
| 2,672,311 | 3/1954 | Schiele | 248/96 |
| 2,751,176 | 6/1956 | Mowry | 248/96 |
| 3,195,844 | 7/1965 | Roepke | 248/96 |
| 4,226,389 | 10/1980 | Neth | 248/96 |
| 4,620,682 | 11/1986 | Yim | 248/96 |

FOREIGN PATENT DOCUMENTS

| | | | |
|---|---|---|---|
| 776533 | 1/1968 | Canada | 248/96 |
| 1138217 | 12/1968 | United Kingdom | 248/96 |

*Primary Examiner*—David L. Talbott

[57] ABSTRACT

A golf bag support for supporting a golf bag in a semi-upright position having a plate which attaches to the upper cuff of a golf bag. Legs are pivotally mounted to the plate thereby allowing the legs to swing outwardly from the bag. A tubular rod guide is rigidly fastened centrally between and parallel to the two legs and accommodates a rod which is free to slide inside of the rod guide. A pair of extender arms are each pivotally attached on one end to the lower end of the rod and on the other end to the lower end of one of the legs. As the legs are employed to support the golf bag, the rod, which contacts the ground first, moves upwardly in the rod guide thereby forcing the extender arms to a nearly horizontal position thereby forcing the legs to be spread apart from each other at their lower ends. At their fully extended position the two legs and rod are in contact with the ground forming a stable base for supporting the golf bag in a semi-upright position. As the bag is lifted by the golfer, thereby removing the weight from the legs, the legs automatically return to their initial, unspread position. A latch mounted on the plate provides a means to retain the legs in a position parallel to the bag while the bag is being carried.

2 Claims, 4 Drawing Sheets

GOLF BAG SUPPORT

BACKGROUND

1. Field of Invention

The present invention relates to a support means for a golf bag to hold the same in a semi-upright position.

2. Description of Prior Art

When playing a round of golf, a player often carries his golf bag which contains his golf clubs. During the round he must lay the bag down on the ground when making a shot. Golf bag supports allow the player to place his bag in a semi-upright position rather than in a prone or horizontal position on the ground. This is advantageous for the player because it allows the player to easily select clubs from his bag and return them to the bag; it keeps the bag from becoming soiled from laying on wet or dirty fairways; and it is less strenuous for the player to pick the bag up when it is to be carried again since he does not have to stoop over as far and he does not have to lift the bag as far to return it to the carrying position.

Since the bag and support are carried the entire round and must be set down and picked up many times, it is advantageous for the golfer if the support is light in weight. It is also advantageous if the support is compact in design thereby allowing the support to be easily attached to the bag in a convenient configuration which is not cumbersome for the golfer as he is carrying the bag. Specifically, golf bag supports with legs which are extendable when the support is employed and retractable to a compact configuration while the bag is being carried are less cumbersome for the golfer to carry.

Heretofore golf bag supports which have legs which are automatically extendable when employed and automatically retractable to a compact configuration when not in use have a main center shaft which is nearly equal in length to the length of the bag. This center shaft is provided with attachment means for attaching the bag to the support. The legs of these supports are typically attached to this center shaft. The center shaft adds considerably to the weight of the support and renders a bag with the support attached bulky and difficult to manage.

Hertofore, other supports have legs which are fixed in a spread position relative to one another so that the support will provide a stable means for supporting the bag. This spread position of the legs makes it difficult and cumbersome to carry the bag and to transport the bag in an automobile.

Heretofore, other supports with legs in a fixed position relative to one another with a narrow span to avoid being difficult and cumbersome to carry are less stable and vulnerable to being blow over by the wind or to falling over when placed on uneven terrain.

The present invention is simple in design and light in weight. It has legs which are automatically extendable when the support is employed and which are automatically retractable when they are not in use. The present invention does not require a center shaft extending the length of the bag thereby resulting in a support which is lighter in weight compared to existing supports with automatically extendable and retractable legs but which have a center shaft. In its employed position wherein the bag is supported in a semi-upright position, the lower ends of the legs of this support are spread apart a sufficient distance to form a stable structure not easily knocked over by wind or when placed on uneven terrain. When the support is not employed to support the bag, the legs of this support automatically retract to a compact configuration convenient for carrying. The legs are held in a position parallel to the bag when the legs are not required for supporting the bag thereby resulting in a support which is not cumbersome to carry or transport when the support is not in use.

OBJECTS AND ADVANTAGES

Accordingly, several objects and advantages of the present invention are listed below. An object of this invention is to provide a means to support a golf bag in a semi-upright position to allow golf clubs to be easily selected from and returned to the golf bag.

Another object of this invention is to provide a means to support a golf bag in a semi-upright position whereby the golf bag will not be subject to lay on wet, muddy, or dirty surfaces where the bag might become wet or soiled.

Another object of this invention is to provide a means to support a golf bag in a semi-upright position whereby it is easier to lift the bag to a position for carrying since the golfer does not have to stoop over as far to pick the bag up and he does not have to lift the bag as far to place it in this carrying position.

Another object of this invention is to provide a means to support a golf bag which is light in weight for ease in carrying.

Another object of this invention is to provide a means to support a golf bag with legs which are in a compact, unspread position when not in use but which automatically spread apart when employed to form a stable support and automatically retract into its original unspread position when the bag is lifted and the support is no longer in contact with the ground.

An advantage of this golf bag support is that it has automatically extendable and retractable legs without a center shaft extending the length of the golf bag and is therefore lighter in weight and more compact than supports having a center shaft.

Another object of this invention is to provide means to support a golf bag which will not be obstructive to the golfer while the bag is being carried or stored.

Further objects and advantages of this invention will become apparent from considerations of the drawings and ensuing description of the invention.

DESCRIPTION OF PREFERRED EMBODIMENT

Figure 1:
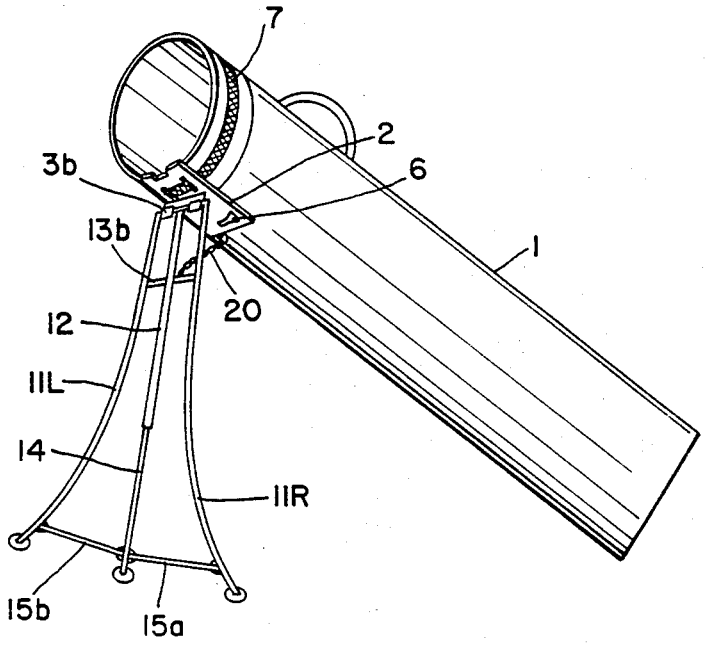
FIG. 1 is a perspective view of the present invention attached to the upper cuff of a golf bag and in an operative position supporting the bag in a semi-upright position.
Figure 4:
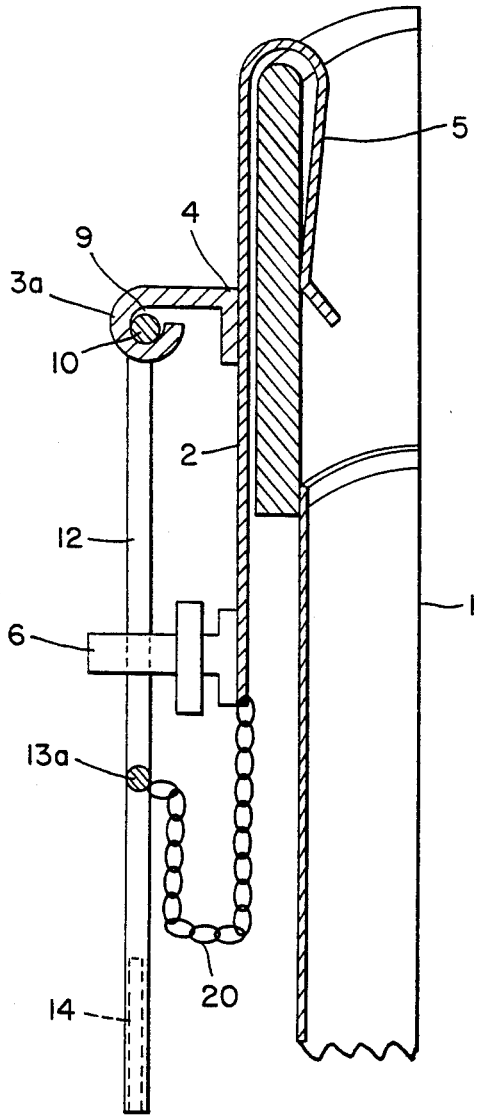
FIG. 4 is a sectional view along line 4—4 of FIG. 2 showing a side view of the support with the legs in a position parallel to the bag.

Referring now in greater detail to the drawings, FIG. 1 is a perspective view of a golf bag 1 with the present invention attached thereto and supporting the bag in a semi-upright position. The support comprises a plate 2 suitably curved to fit the contour of the side of a golf bag. As shown in FIG. 4, clamps 5 provide means for attaching the plate 2 to the upper cuff of the golf bag 1 said clamps formed integral with plate 2 from strips which extend beyond the top edge of the plate on either side and are turned backwardly suitably adjacent to the back of the plate 2 for securing the plate to the bag 1. Plate 2 is further secured to the bag with a strap 7 which is looped through slots 8 which are openings in plate 2.

Figure 2:
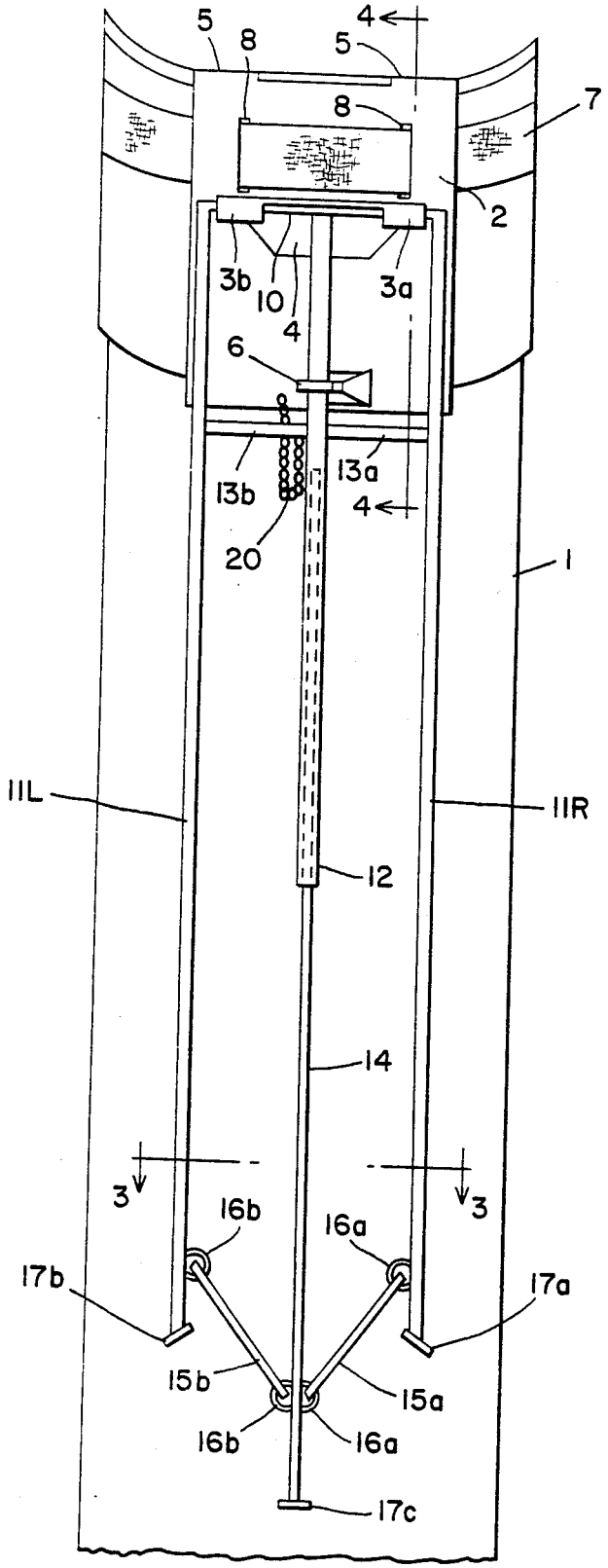
FIG. 2 is a detailed view of the support attached to the upper cuff of a golf bag with the legs in retracted position.

Referring to FIGS. 2 and 4, attached to the plate 2 by suitable fastening means such as rivets or welding is a hinge plate 4 with hinge elements 3*a* and 3*b* suitably shaped to form hinge eyes 9. The cross bar 10 which is formed integral with the two legs 11L and 11R passes through the hinge eyes 9. The rod guide 12 is a tube which is fastened by suitable means such as welding at right angles to the cross bar 10 and in a plane formed by the legs 11L and 11R, and equidistant between the two legs. Rod guide 12 is further supported in position between the legs by cross supports 13*a* and 13*b*. Cross support 13*a* is fastened by suitable means such as welding at one end to leg 11R and at the other end to rod guide 12 in a position perpendicular to both. Similarly, cross support 13*b* is fastened by suitable means such as welding at one end to leg 11L and at the other end to rod guide 12. Thus legs 11L and 11R and rod guide 12 are, at their upper ends, fixed in position relative to one another, are parallel to one another, and are all in the same plane.

Figure 3:
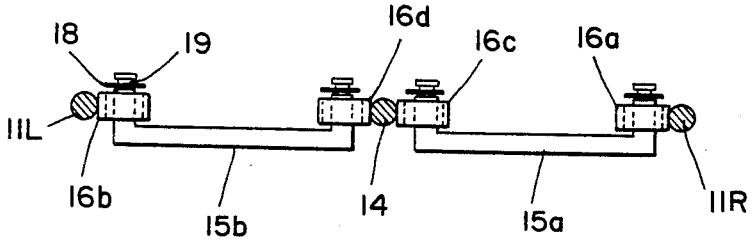
FIG. 3 is a sectional view along line 3—3 of FIG. 2 showing a top view of the elements which provide the means for spreading the legs to their operative position.

Rod 14 is free to slide inside of the rod guide 12. Extender arm guides 16*a* and 16*b* are fastened by suitable means such as welding to the interior side of legs 11R and 11L respectively. Extender arm guides 16*c* and 16*d* are fastened by suitable means such as welding on opposite sides of rod 14. As shown in FIG. 3, extender arms 15*a* and 15*b* have ends which are bent at right angles to the main body of the arm. Th ends of extender arm 15*a* fit through extender arm guides 16*a* and 16*c*. Similarly, the ends of extender arm 15*b* fit through the extender arm guides 16*b* and 16*d*. The inner diameters of the extender arm guides 16*a*, 16*b*, 16*c*, and 16*d* are slightly larger than the diameter of the extender arms 15*a* and 15*b* thus allowing the extender arms to pivot freely in the extender arm guides. The extender arms are held in position in the extender arm guides by suitable means such as C-spring clips 18 seated in grooves 19 as shown in FIG. 3.

Foot pads 17*a*, 17*b*, and 17*c* are fastened by suitable means such as welding to the lower ends of legs 11L and 11R and rod 14.

When the bag is to be placed in supported position as shown in FIG. 1, the legs will pivot in the hinge 3 outwardly from the bag to a nearly vertical position. As the bag is lowered to a position to be supported by the legs, the weight of the bag and golf clubs within the bag will cause the rod 14 to slide upwardly in the rod guide 12. The upward movement of the rod will force the extender arms 15*a* and 15*b* to a nearly horizontal position thereby forcing the legs 11L and 11R outward from the rod 14 thus spreading the lower ends of the legs apart from each other. The length of the rod 14 is such that when said rod has reached the limit of its travel within the rod guide, the extender arms will reach a nearly horizontal position. The length of the main body of the extender arms is approximately one half of the desired spread distance of the lower ends of legs 11 said length being greater than the distance between each leg and the rod 14 when said legs are in their unspread position. With the legs thus spread apart at their lower ends, a stable support is provided for holding the bag in a semi-upright position. In this preferred embodiment, the legs are made from a material with resilient, spring property whereby as the weight of the golf bag with golf clubs is lifted from the legs, the legs will return to their original, unspread position parallel to each other.

The foot pads 17*a*, 17*b*, and 17*c* add to the stability of the support by preventing the legs 11 and rod 14 from penetrating the surface upon which the support rests. A flexible member 20 such as a chain is suitably fastened on one end to the plate 2 and on the other end to the rod guide 12. Said flexible member is of suitable length to restrict the movement of the legs outward from the bag to a position which is approximately at right angles to the bag.

A latch 6 provides a means for retaining the legs in a position parallel to the bag when said latch engages the rod guide 12. With the legs thus retained, the bag can be easily carried without interference from the legs. When the support is to be employed, the latch 6 is disengaged thereby releasing rod guide 12 and allowing the legs to pivot freely in the hinge 3 to a nearly vertical position ready for supporting the bag in a semi-upright position.

Thus, from the foregoing description of the preferred embodiment, a golf bag support has been disclosed which attached easily to the upper cuff of golf bags of differing types. This invention is light in weight and provides a stable support means for supporting a golf bag in a semi-upright position. This invention is convenient for the golfer because the legs automatically extend to a wider, stable position when the support is in operation and automatically retracts into a compact, unobstructive configuration when not supporting the bag. A latch means is provided whereby the legs can be held in a position parallel to the bag so that the legs will not be any annoyance while the bag is being carried or otherwise transported.

While the preferred embodiment of this invention has been described, it should be understood that this description is for illustration only and not to be interpreted as limiting the scope of the claims which follow.

I claim:

1. A support device for supporting a golf bag or the like comprising a plate, attachment means for attaching said plate to the uppercuff of a golf bag, a pair of deflectable legs, a cross bar connecting said legs at their upper ends, a tubular rod guide having length less than the length of said legs, fastening means for rigidly fastening said rod guide at its upper end between said legs in a fixed position relative to the upper end of said legs whereby said rod guide is coplanar with, centrally located between, and parallel to said legs when said legs are in their unextended position, attachment means for swingably attaching said legs and said guide to said plate, a rod slidable within said tubular rod guide, and a pair of extender arms each pivotally connected at one end to the lower end of said rod and pivotally connected at the other end to the lower end of one of said legs whereby said rod is held in position with its upper portion within said rod guide and its lower portion extending outwardly from the lower end of said rod guide said extender arms providing means for spreading the lower, free ends of said legs apart from each other when the support is employed to support the golf bag.

2. A golf bag support of claim 1 wherein said legs are made of material with resilient, spring property whereby when the support is not bearing the weight of the bag and clubs, said legs will return to their original non-spread position parallel to each other.

* * * * *